US006663103B2

(12) United States Patent
Dobberstein et al.

(10) Patent No.: US 6,663,103 B2
(45) Date of Patent: Dec. 16, 2003

(54) PROCESS AND DEVICE FOR ALIGNMENT OF SHEET MATERIAL DURING TRANSPORT

(75) Inventors: Dieter Karl-Heinz Dobberstein, Melsdorf (DE); Joachim Heinrich Haupt, Eschorn (DE); Karlheinz Walter Peter, Molfsee (DE); Jürgen Sahlmann, Ellerdorf (DE); Gerhard Rudolf Sing, Kiel (DE); Rolf Johannes Spilz, Gettorf (DE); Hans-Günter Werner Staack, Kiel (DE); Frank Pierel, Kiel (DE); Lutz Michael Wagner, Kiel (DE)

(73) Assignee: NexPress Solutions LLC, Rochester, NY (US)

( * ) Notice: Subject to any disclaimer, the term of this patent is extended or adjusted under 35 U.S.C. 154(b) by 5 days.

(21) Appl. No.: 09/850,292

(22) Filed: May 7, 2001

(65) Prior Publication Data

US 2002/0011706 A1 Jan. 31, 2002

(30) Foreign Application Priority Data

May 17, 2000 (DE) ..... 100 23 940

(51) Int. Cl.[7] ..... B65H 7/02
(52) U.S. Cl. ..... 271/227; 271/228; 271/236
(58) Field of Search ..... 271/227, 228, 271/236

(56) References Cited

U.S. PATENT DOCUMENTS

| | | | | |
|---|---|---|---|---|
| 5,078,384 A | * | 1/1992 | Moore | 271/228 |
| 5,156,391 A | * | 10/1992 | Roller | 271/227 |
| 5,169,140 A | * | 12/1992 | Wenthe, Jr. | 271/228 |
| 5,681,036 A | * | 10/1997 | Wakahara et al. | 271/227 X |
| 5,697,609 A | * | 12/1997 | Williams et al. | 271/228 |
| 5,794,176 A | * | 8/1998 | Milillo | 271/228 X |
| 6,019,365 A | * | 2/2000 | Matsumura | 271/227 |
| 6,059,285 A | | 5/2000 | Suga et al. | |

FOREIGN PATENT DOCUMENTS

| | | |
|---|---|---|
| DE | 44 16 564 A1 | 5/1994 |
| EP | 09 47 455 A1 | 3/1999 |
| WO | 98 18 053 A1 | 4/1998 |

* cited by examiner

*Primary Examiner*—David H. Bollinger
(74) *Attorney, Agent, or Firm*—Lawrence P. Kessler

(57) ABSTRACT

The invention relates to a process and a device for alignment of sheet material (1) which is conveyed in one conveyor plane (9). The sheet material is conveyed on bodies (35) of revolution and aligned by means of triggerable alignment elements (25) in the conveyor direction (22) and perpendicular to the conveyor direction (22). The alignment elements (25) are assigned to an alignment unit (8). The alignment motion necessary for alignment of the sheet material in the conveyor direction (2) and perpendicular thereto takes placed by separate alignment elements (25) which can be triggered independently of one another during conveyance of the sheet material (1) with the process speed.

1 Claim, 4 Drawing Sheets

Fig.8
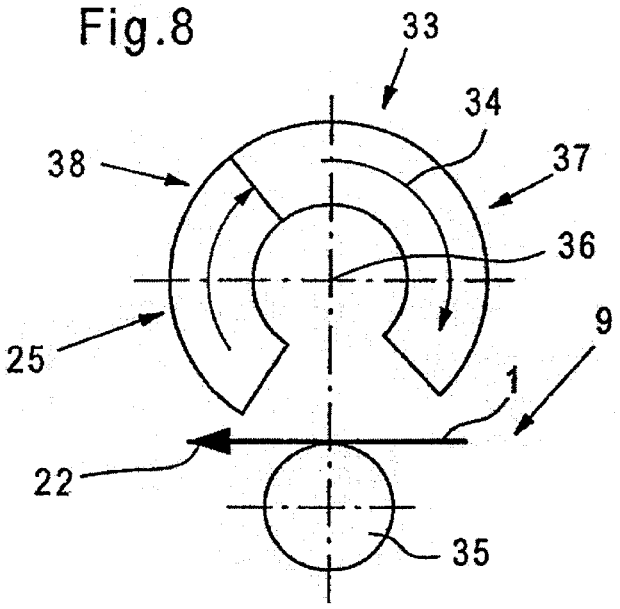
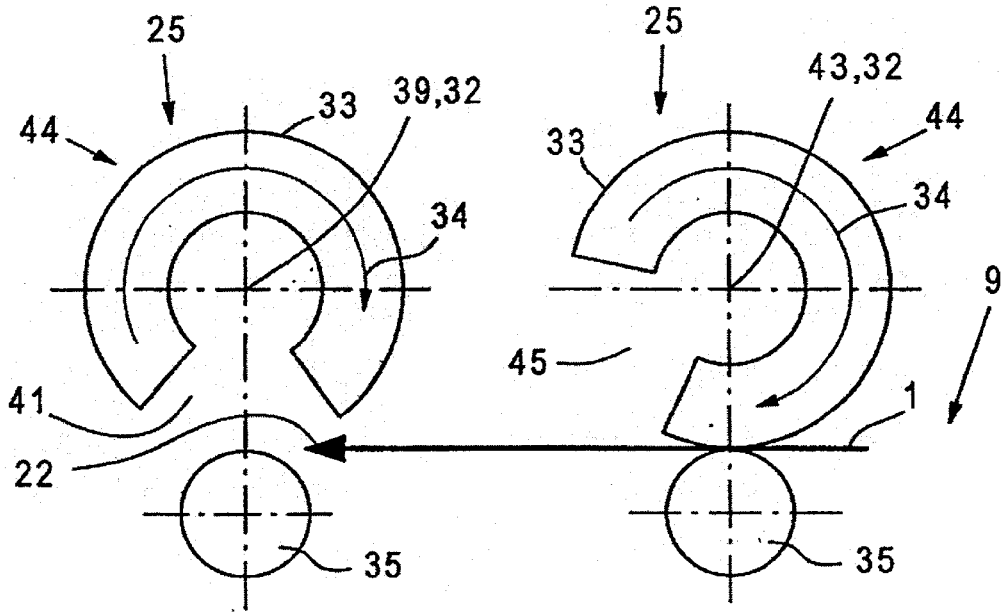
Fig.9

PROCESS AND DEVICE FOR ALIGNMENT OF SHEET MATERIAL DURING TRANSPORT

FIELD OF THE INVENTION

The invention relates to a process and a device for alignment of sheet material during its transport in orthogonal directions in its conveyor plane before processing in a machine which processes sheet material.

BACKGROUND OF THE INVENTION

U.S. Pat. No. 5,322,273 discloses a sheet alignment device. This device for alignment of a sheet moving along an essentially flat transport path enables alignment of a moving sheet in a plurality of orthogonal directions, for example transversely to the transport path, in the direction of the transport path, and to eliminate skewed positions. The sheet alignment device has a first roller arrangement with a first pressure roller which is supported such that it can turn around one axis which lies in a plane which extends parallel to the plane of the transport path and runs essentially at a right angle to the direction of sheet transport along the transport path. A second roller arrangement has a second pressure roller which is supported such that it can turn around one axis which lies in a plane which extends parallel to the plane of the transport path and runs essentially at a right angle to the direction of sheet transport along the transport path. There is a third roller arrangement which has a third pressure roller which is supported such that it can turn around one axis which lies in a plane which extends parallel to the plane of the transport path and runs essentially at a right angle to the direction of sheet transport along the transport path. The third roller arrangement which can turn around one axis which lies in a plane which extends parallel to the plane of the transport path and runs essentially at a right angle to the direction of sheet transport along the transport path can be moved along its axis of rotation in the direction which runs transversely to the transport path. Finally, there is a control means which is dynamically connected to the first and the second and the third roller arrangement and selectively controls the rotation of the first and second roller arrangement in order to align the front edge of a sheet moving in the direction of sheet transport along the transport path into the position which is at a right angle to the direction of sheet transport. The control means furthermore controls the rotation and the transverse motion of the third roller arrangement in order to align the moving sheet in the direction which runs transversely to the direction of sheet transport and in the direction in which the sheet is moving along the transport path.

The sheet alignment device known from U.S. Pat. No. 5,322,273 enables the required alignment accuracies to be satisfied only to a limited degree. To achieve the required alignment accuracies, extensive modification of the sheet alignment device of the prior art is necessary, which modification does not seem economical.

In sheet-processing printing presses which work using the offset principle, the sheets are conveyed on the feed table in a ragged arrangement before they are aligned on the side and pull-type lay marks which are provided in the plane of the feed table. After completed alignment of the sheet material it is transferred in the aligned state to a pre-gripper which accelerates the sheet material to the press speed and transfers it to the sheet-guiding cylinder which is located downstream of the pre-gripper means. Other alignment concepts generally use cylindrical rollers with a rubber coating which can be held on their core. If with this configuration alignment of the sheet material is carried out during its feed by changing the speed between the left and right roller which grip the sheet material, the sheet material undergoes rotation around a pivot which is located on the stationary roller or during feed is located outside the roller with lower rpm or between the two rollers.

When the sheet material is being aligned by segmented rollers, a segment path of less than 360 degrees is available for the correction motion by the alignment elements if they are made as segmented rollers. If the sheet material is aligned in the conveyor direction and transversely to the conveyor direction by alignment elements which sit on an axle, the available segment path of <360 degrees is divided among the two alignment functions. If the alignment process takes place in start-stop operation, the necessary segment path is minimal. Since however here the continuous feed of sheet material is interrupted, in front of the alignment unit either there can be a paper reservoir, for example in the form of staggering of the sheets, or a relatively large distance can be maintained between the individual copies of the sheet material, by which there the process speed of the machine which processes the sheet material is limited. In the alignment process of the sheet material by means of a segmented roller, the problem necessarily arises that the alignment motion is limited to the maximum available segment periphery. An increase in the size of the periphery of the alignment element in the form of a segmented roller by increasing the diameter as the positioning accuracy on the segment periphery remains the same would entail a higher angular resolution of the pertinent actuator and thus follow-up costs, which is worth avoiding.

The object of the invention in view of the approach known from the prior art and the indicated technical problem is to undertake the correction movement necessary for alignment of the sheet material during its transport.

SUMMARY OF THE INVENTION

The advantages which can be achieved with the approach in the invention are mainly that by dividing the alignment functions between an alignment function in the conveyor direction of the sheet material and an alignment function perpendicular to the conveyor direction of the sheet material, a complete segment periphery of 360 degrees is available for each individual alignment function. Thus the alignment path can be increased for the individual functions with the resolution remaining the same. A uniform resolution allows retention of the segment periphery; higher angular resolution which is necessary due to the increase of the segment periphery and thus higher resolution of the pertinent actuator can be omitted. Another advantage lies in that the motion sequences take place in the conveyor direction of the sheet material and transversely thereto, independently of one another. Therefore the sheet material need no longer be stopped or braked for its alignment in at least two planes, but the correction movements can be superimposed using the complete peripheral surfaces of the alignment elements on the process speed, i.e. the feed rate of the sheet material to the processing machine which processes sheet material. Thus, the feed rate can be increased since braking processes are not necessary. Furthermore, a paper reservoir unit which represents additional cost can be omitted.

In another embodiment of the process in the invention, on the alignment elements for alignment of the sheet material their entire peripheral surface can be used. Thus, reliable alignment of the sheet material is ensured even at the highest feed rates. The alignment elements can be triggered independently of one another using the process proposed as claimed in the invention, especially via separate drives. The alignment functions on the sheet material can take place, viewed in its conveyor direction, horizontally in succession, thus for example first of all alignment in the conveyor direction, subsequent to which alignment can then take place transversely to the conveyor direction.

By using the periphery which extends on the segmented rollers for example as a three-quarters circle, an increase in diameter of the segmented rollers and a concomitant increase of the resolution of the actuators can be avoided. Thus higher costs do not arise in alignment of sheet material with the process proposed as claimed in the invention.

Likewise, in the invention a device for alignment of sheet material is proposed where the alignment elements are driven via alignment of the sheet material in the conveyor direction or transversely thereto via drives which are independent of one another. By means of the alignment element drives which are independent of the feed drive of the sheet material, decoupling of the alignment processes from the feed motion and this superposition of the alignment function on the feed function can be guaranteed.

In one advantageous embodiment of the process proposed in the invention, for the individual function of alignment in the lengthwise direction of the sheet material and transversely thereto the complete segment periphery of the alignment element is available. The segment periphery, depending on the size of the interruption on the periphery of the segment, can be less than 360 degrees, preferably the peripheries on the segments can have a three quarters circular arc extension.

The alignment device proposed in the invention which comprises division of the respective alignment function in the conveyor direction of the sheet material and transversely thereto, can be implemented on feed means such as a feeder for sheet material and can be used to advantage on machines which process sheet material. These machines can be for example printing presses, digital printing units and also printing presses which print images digitally or directly.

BRIEF DESCRIPTION OF THE DRAWINGS

The invention is detailed below using drawings.

FIG. 8 shows an alignment element with a peripheral surface which is occupied in areas by two different alignment functions; and FIG. 9 shows two alignment elements, for which one alignment function at a time is implemented and which are located above the conveyor plane of the sheet material.

DETAILED DESCRIPTION OF THE INVENTION

Figure 1:
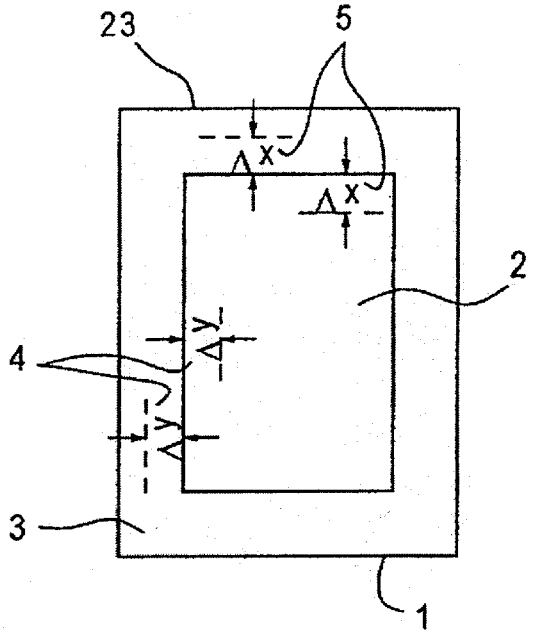
FIG. 1 shows the developing position deviation of a printed image relative to the surface of the print material which accommodates it.

FIG. 1 shows sheet material, for example a printed sheet 1, which is oriented at a right angle to its feed direction 22. The printed sheet 1 contains on its surface a printed image 2 which is surrounded by a frame-like edge 3. The deviations of $\Delta x$ and $\Delta y$ which are marked within the printed surface 2 and the frame 3, designated the positioning errors in the X and Y direction 4 and 5, can be adjusted when printing the image 2 onto the surface of the sheet material 1. The deviations labeled with reference numbers 4 and 5 are position deviations, conversely in the representation as shown in FIG. 2 angle deviations of the printed image 2 are shown with reference to its position on the sheet material 1.

Figure 2:
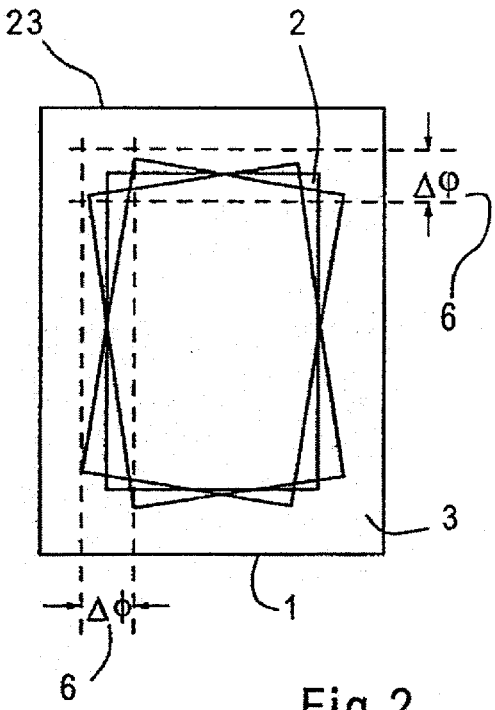
FIG. 2 shows the offset of the printed image on the sheet material, i.e. the offset characterized by a rotary offset.

In FIG. 2 the developing angular errors $\Delta\phi$ are labeled with reference number 6. The printed image 2 can be printed in the indicated positions onto the surface of the sheet material 1, this material being conveyed in the conveyor direction 22 with its front edge 23 forward.

Figure 3:
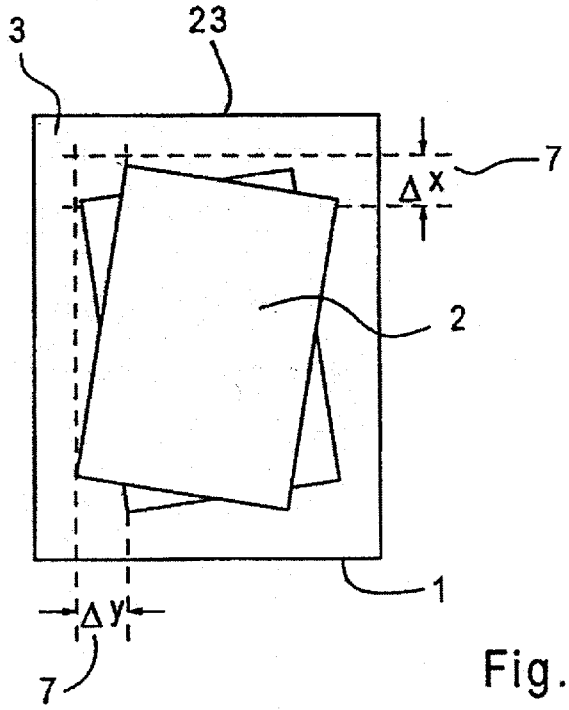
FIG. 3 shows the offset of the image which has been printed on the bottom and top of sheet material in perfecting.

FIG. 3 shows in a schematic view the turning register, and the offsets which develop between the printed images 2 on the front and back of the sheet material 1 can be characterized with reference number 7. These offsets are labeled with reference number 7 and $\Delta x$ and $\Delta y$ in FIG. 3. The turning register plays a part especially in translucent types of paper, extremely light paperweights, and when printing booklets.

Figure 4:
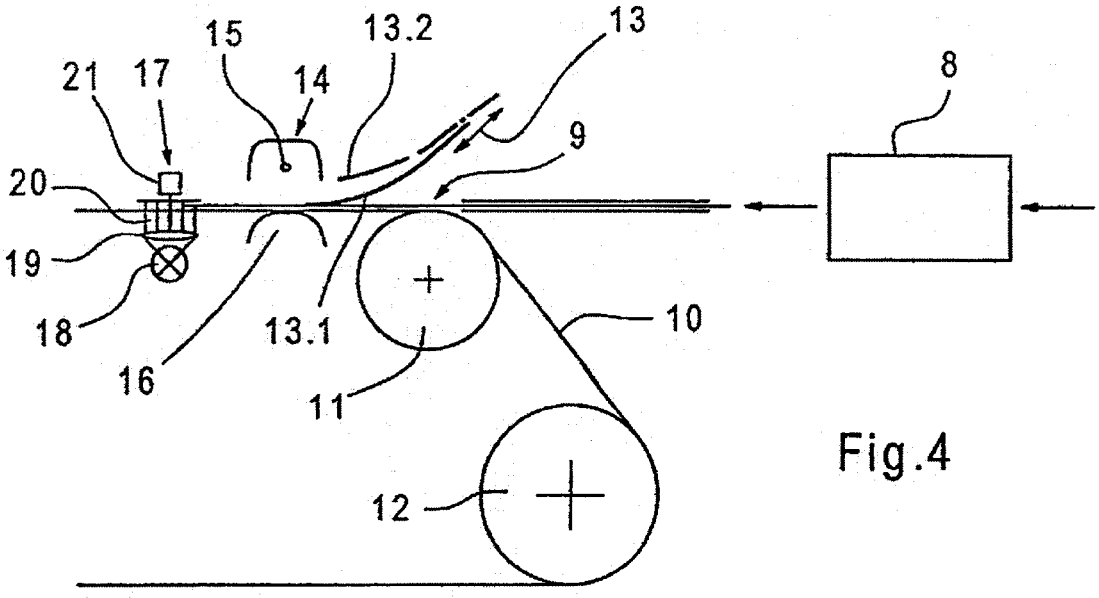
FIG. 4 schematically shows a side view of the sheet feed area of a sheet processing machine.

FIG. 4 shows in a schematic side view the interface of sheet alignment and feed onto a transport belt.

An alignment unit 8 is connected upstream of a transport belt 10 which runs around a feed roller 11 and a control roller 12; on the surface of the belt the sheet material 1 is held in the conveyor plane 9. After passing the alignment unit 8 which will be described in greater detail below, the aligned sheet material 1 on the surface of the transport belt 10 travels to the conveyor plane 9. After passing the feed roller 11 the sheet material 1 is captured by an adjustment flap or adjustment lip 13 which can be moved in the adjustment direction. The adjustment lip or adjustment flap can be a plastic component which can be moved from the adjusted position 13.1 into the stopped position 13.2; this is shown here only schematically in solid or broken lines. The adjustment flap or adjustment lip 13 presses the sheet material 1 onto the surface of the transport belt 10 in the aligned state of the sheet material 1. After passing the pressure element 13 the sheet material 1 which is held on the surface of the transport belt 10 passes a charging unit 14. In the charging unit 14, inside a hood-shaped cover there is an electrode 15 which provides for static charging of the sheet material 1 and thus for its adhesion to the surface of the transport belt 10.

A front edge sensor 17 follows the charging unit 14 which is shown only schematically in FIG. 4. This sensor consists of a radiation source 18 which is located underneath the conveyor plane 9 and to which a lens arrangement 19 is series connected. The radiation field 20 proceeding from the lens arrangement 19 penetrates the conveyor plane 9 in which the sheet material 1 is conveyed and is incident on a diaphragm arrangement which is located above the conveyor plane 9 of the sheet material 1. The diaphragm arrangement precedes a receiver 21 which senses the presence of the front edge 23 of the sheet material 1.

Figure 5:
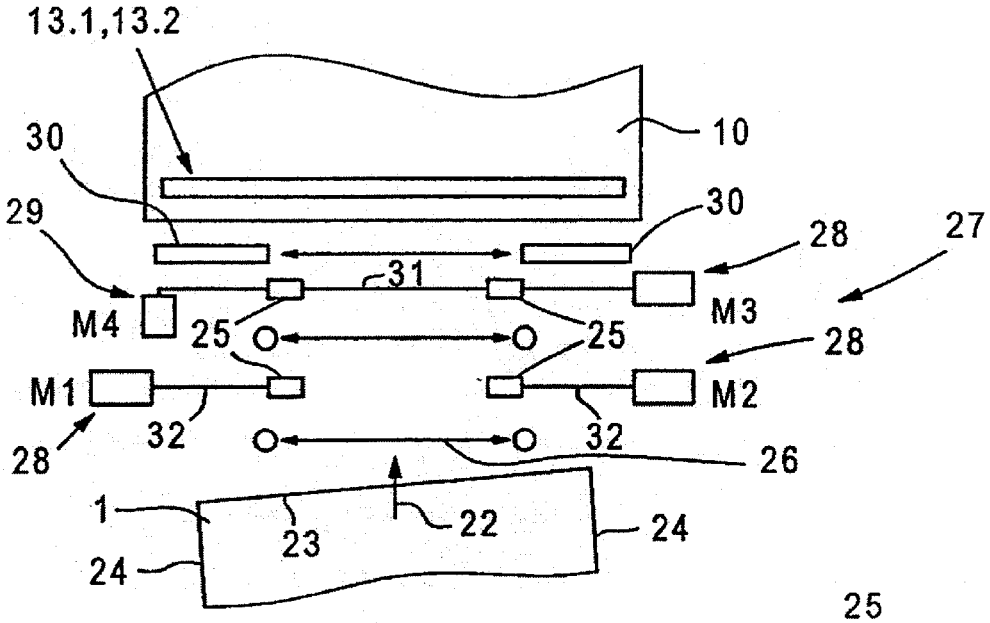
FIG. 5 shows a plan view of the alignment components, the sensor technology and drives for the sheet material relative to the rotation elements which align the direction in which the sheets run.

FIG. 5 shows in a plan view the alignment unit 8 with its components which are shown schematically here. The alignment unit 8 is reached by the sheet material 1 which is conveyed in the conveyor direction 22. The front edge 23 of the sheet material 1 is offset with respect to the conveyor direction 22 of the sheet material 1, by which the side edges 24 of the sheet material 1 begin to run skewed from its front edge 23. As soon as the front edge 23 of the sheet which is in the skewed position with respect to the conveyor direction 22 runs over a first photoelectric barrier 26, the drives 27, labeled M 1 and M 2, which drive rotation elements 25 via individual axles 32, are accelerated to the feed rate. Triggering of the drives 27 and M 1 or M 2 which is initiated via the photoelectric barrier 26 ensures that each copy of the sheet material 1 comes into contact with identical peripheral segments of the rotation elements 25 which are made for example as segmented rollers and which are used for alignment. Any developing differences in the feed motion which could be attributed to the dimensional and shape tolerances of the alignment elements 25 thus occur in the same way for each copy of the sheet material 1 and can be easily calibrated out.

After the rotation elements 25 are set into rotation by passing the first photoelectric barrier 26, the sheet material 1 is transported with the feed rate over another sensor unit 30.1 which follows the first photoelectric barrier 26. As soon as the first of the two sensors of the sensor pair 30.1 has detected the front edge 23 of the sheet material 1, a counter unit begins to count the motor steps. The counting process is then ended and the difference is ascertained when the second sensor of the sensor pair 30.1 operates.

The counter state which has been determined in this way allows determination of a correction value which drives as additional feed to the segmented roller which was started last, i.e. either to the drive 27 which is labeled M 1, or to the drive 27 which is labeled M 2. In this way the corresponding body of revolution 25 which is made as a segmented roller is accelerated to an increased feed rate until the stipulated path difference is completely equalized. At the end of this correction process which is superimposed on the transport motion of the sheet material 1, the front edge 23 of the sheet material is oriented exactly perpendicularly to the conveyor direction 22.

After completed correction, the sheet material 1 in the conveyor direction 22 is continuously transferred from the first pair of segmented rollers 25 to the other pair of segmented rollers 25 which follows it and which can be accommodated on a common axis 31. At this point the segmented roller pair 25 which is driven via the drive 27 or M 1 and M 2 is turned off and moves into a neutral position.

Figure 7:
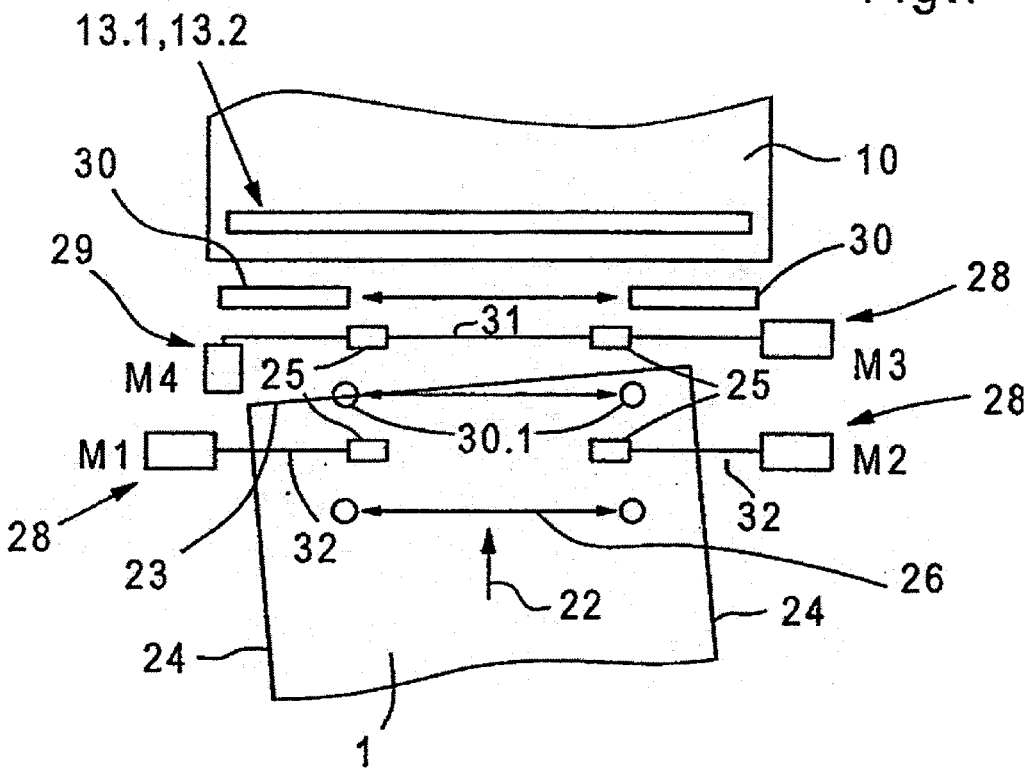
FIG. 7 shows the alignment of sheet material with the drives of the segmented rollers which carry out alignment.

The sheet material 1 which is now correctly aligned with respect to its angular position now runs into a sensor array 30 in which the position of the side edges 24 of the sheet material 1 is measured. The change in position for the drive 27 which is labeled M4 and which has a drive shaft which extends parallel to the conveyor direction 22 is determined from the established measured value. By means of this drive 27 which is held in a second orientation 29, the position of the sheet material 1 parallel to the direction 22 in which it is running is corrected (compare FIG. 7).

Afterwards, the sheet 1 which is aligned in its angular position and its lateral position runs underneath an adjustment element 13, which has been placed in a position 13.1 or 13.2, onto the transport belt 10 in order to run into the for example downstream printing unit in the correctly aligned position.

Figure 6:
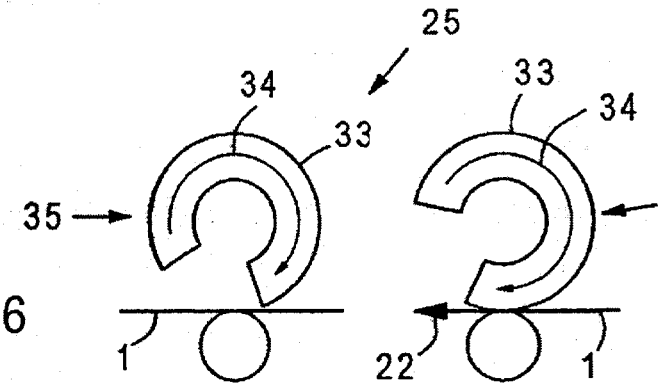
FIG. 6 shows the rotation elements which are made as segmented rollers above the conveyor plane of the sheet material.

FIG. 6 shows one embodiment of the segmented rollers 25 which are located above the conveyor plane 9 for the sheet material 1 and which are held in the alignment unit 8. The rotation elements 25 in one preferred embodiment can be made as segmented rollers which have a peripheral surface 33 which is characterized by an interruption. The segmented rollers 25 rotate in direction 34, characterized by the illustrated arrow, and describe roughly a three quarters circle with reference to their axes of rotation. Underneath the respective segmented rollers 25, i.e. underneath the sheet conveyor plane 9, rollers 35 which support the sheet material 1 are shown.

FIG. 8 shows an alignment element which is made as a segmented roller.

The peripheral surface 33 of the alignment element 25 as shown in FIG. 8 is occupied by two alignment function areas. The alignment element 25 rotates around its axis 36 of rotation which is located parallel to the conveyor plane 9 of the sheet material 1. The peripheral surface 33 of the alignment element 25 which is made as a segmented roller 25 moves in the direction of rotation 34 characterized by the corresponding arrow. The peripheral surface 33 of the alignment element 35 is made as a three quarters circle and is provided with an interruption. With this alignment element configuration which is known from the prior art an area of about 90 degrees can be used to undertake alignment of the sheet material 1 transversely to the conveyor direction 22, while the remaining peripheral surface 33 of the sheet material 1 can be used to align the sheet material 1 in the conveyor direction 22.

On the bottom of the sheet material 1 it is supported in the conveyor plane 9 by bodies 35 of revolution for example in the form of rings or support rollers.

FIG. 9 shows alignment elements which are held on axes of rotation parallel to one another and which can be driven independently of one another.

Viewed in the conveyor direction 22 of the sheet material 1, above the conveyor plane 9 there are alignment elements 25 which each have peripheral surfaces 33 which describe a three quarters circle. The peripheral surfaces 33 of the alignment elements 25 rotate in the direction of rotation 34 and are provided with one interruption 41 and 45 each and extend essentially over a peripheral area around their respective axes of rotation 39, 43 which is less than 360 degrees, preferably describes a three quarters circle.

The individual alignment elements 25 rotate around their respective axes 39 and 43 of rotation by application of the drives 27 which can be triggered independently of one another and which have driven shafts which are connected to the individual shafts 32 which run coaxially to the axes 39 and 43 of rotation of the alignment elements 25. Thus, for alignment of the sheet material 1 in the lengthwise direction, i.e. in the conveyor direction 22 the complete length 33 of the peripheral surface of the first alignment is available, conversely to align the sheet material 1 transversely to its conveyor direction 22 the entire peripheral surface 33 of the other alignment element 25 which adjoins in the conveyor direction 22 behind the alignment element 25 for alignment transversely to the conveyor direction 22, which peripheral surface comprises less than 360 degress, is available. Underneath the conveyor plane 9 in which the sheet material 1 is conveyed in the conveyor direction 22, the bodies 35 of revolution are in the shape of the ring or cylinder, on the outside surfaces of which the bottom of the sheet material 1 which runs in the conveyor direction 22 to the sheet processing machine is supported.

With the division of the functions of alignment of the sheet material 1 in the conveyor direction 22 and transversely thereto which was proposed as claimed in the invention among two axes 39, 32 and 43, 32 of rotation which are located parallel to one another, the entire segment periphery 33 of <360 degrees is obtained for each individual alignment function. Thus the alignment path can be increased for each individual function with the uniform resolution and given applicability of an existing actuator element. Another advantage of the approach proposed as claimed in the invention is that the motion sequences of the alignment functions can be triggered independently of one another. Thus braking or even stopping of conveyance of the sheet material 1 in the conveyor plane 9 for its alignment can be avoided, since the correction motions in the conveyor direction 22 and transversely thereto can be superimposed on the process speed, i.e. the feed rate of the sheet material 1. In this way the conveyor speed of the sheet material 1 of the machine can be increased and the smallest possible distances between individual copies of the sheet material 1 in its feed to the sheet-processing machine, for example to a picture printing or printing machine can be achieved.

The invention has been described in detail with particular reference to certain preferred embodiment thereof, but it will be understood that variations and modifications can be effected within the spirit and scope of the invention.

Reference Number List

1 sheet material
2 printed image
3 frame
4 position error, y direction
5 position error, x direction
6 twist error
7 offset, front/back
8 alignment unit
9 conveyor plane
10 transport belt
11 feed roller
12 control roller
13 adjustment element
13.1 first position
13.2 second position
14 charging unit
15 electrode
16 support
17 front edge sensor
18 radiation source
19 lens
20 radiation field
21 radiation receiver
22 conveyor direction
23 front edge
24 side edge
25 segmented roller
26 photoelectric barrier
27 drives, segmented rollers
28 first orientation, drive 27
29 second orientation, drive 27
30 sensor array
30.1 sensor pair
31 common shaft
32 individual shaft
33 periphery of the segmented roller
34 direction of rotation
35 body of revolution
36 axis of rotation
37 coating segment, lengthwise alignment
38 coating segment, transverse alignment
39 axis of rotation
40 segmented roller, lengthwise direction
41 interruption
42 peripheral surface
43 axis of rotation
44 segmented roller, transverse direction
45 interruption
46 peripheral surface.

We claim:

1. Device for alignment of sheet material (1), transported in a conveyor plane (9), and on bodies (35) of revolution, comprising:

an alignment unit (8) including triggerable alignment elements (25) for aligning respective sheets of material in the conveyor direction (22) and in the direction perpendicular thereto, said triggerable alignment elements (25) for alignment of the sheet material (1) respectively having complete segment peripheries (33) available for the individual functions of the alignment processes, each of said segment peripheries (33) formed essentially by a three quarters circular arc, said alignment elements (25) being selectively driven in the conveyor direction (22) and transversely thereto via drives (27) of said alignment unit (8), which drives (27) are separated from one another, held on parallel axes (39, 43) of rotation for the lengthwise and transverse alignment of the sheet material (1), and are independent of one another.

* * * * *